US006408922B2

(12) United States Patent
Desrochers

(10) Patent No.: US 6,408,922 B2
(45) **Date of Patent: *Jun. 25, 2002**

(54) SELF-SUPPORTING CONSTRUCTION FRAME AND METHODS OF USE THEREOF FOR THE INSTALLATION OF DOORS AND WINDOWS

(76) Inventor: Don Desrochers, 1809 Buccaneer Ter., Sarasota, FL (US) 34231

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/305,677

(22) Filed: May 5, 1999

(51) Int. Cl.[7] ..... A47H 1/00

(52) U.S. Cl. ..... 160/24; 160/31; 52/656.9; 49/504

(58) Field of Search ..... 160/23.1, 31, 370.22, 160/DIG. 16, 24; 52/656.9, 656.7, 656.6; 49/504

(56) References Cited

U.S. PATENT DOCUMENTS

| | | | | |
|---|---|---|---|---|
| 514,966 | A | | 2/1894 | Schluns |
| 1,113,721 | A | | 10/1914 | Watson |
| 1,143,718 | A | | 6/1915 | McPherson |
| 1,340,797 | A | | 5/1920 | Schoch |
| 1,608,667 | A | | 11/1926 | Poetsch |
| 1,745,208 | A | * | 1/1930 | Dixson |
| 1,877,853 | A | * | 9/1932 | Gronbeck |
| 2,015,993 | A | | 10/1935 | Drake |
| 2,025,630 | A | * | 12/1935 | Yartyan |
| 2,098,105 | A | | 11/1937 | Nye |
| 2,270,978 | A | * | 1/1942 | Swormstedt |
| 2,543,118 | A | * | 2/1951 | Maffei |
| 2,580,776 | A | | 1/1952 | Herman |
| 2,605,823 | A | | 8/1952 | Lockhart |
| 3,782,054 | A | * | 1/1974 | Goss, Jr. |
| 3,842,890 | A | | 10/1974 | Kramer et al. |
| 4,234,032 | A | * | 11/1980 | Stark ..... 160/26 |
| 4,458,739 | A | | 7/1984 | Murray et al. |
| 4,658,879 | A | * | 4/1987 | Van Klompenburg |
| 4,821,786 | A | | 4/1989 | Johnston |
| 4,944,341 | A | * | 7/1990 | Trippner et al. ..... 160/31 |
| 5,505,244 | A | * | 4/1996 | Thurmann ..... 160/23.1 |
| 5,564,770 | A | * | 10/1996 | Smith et al. ..... 160/370.22 |
| 5,655,587 | A | * | 8/1997 | Kraler ..... 160/31 |
| 5,671,580 | A | * | 9/1997 | Chou |
| 5,671,790 | A | * | 9/1997 | Andersen et al. ..... 160/31 |
| 5,875,602 | A | * | 3/1999 | Lappin et al. |

* cited by examiner

*Primary Examiner*—Blair M. Johnson
(74) *Attorney, Agent, or Firm*—Banner & Witcoff, Ltd.

(57) ABSTRACT

A self-supporting construction frame, with two vertical portions; and two horizontal portions. In the construction frame, one of the two vertical portions is an anchor portion; and the two horizontal portions are detachably coupled to the two vertical portions. A method of using the construction frame for installation of doors and windows is also disclosed.

20 Claims, 14 Drawing Sheets

SELF-SUPPORTING CONSTRUCTION FRAME AND METHODS OF USE THEREOF FOR THE INSTALLATION OF DOORS AND WINDOWS

FIELD OF THE INVENTION

The present invention relates to an easily installable self-supporting construction frame, and, in particular, a self-supporting construction frame accommodating a retractable screen. The self-supporting construction frame has two vertical portions; and two horizontal portions. In the construction frame, one of the two vertical or horizontal portions is an anchor portion; and the two horizontal portions are detachably coupled to the two vertical portions. A method of using the construction frame for installation of doors and windows is also disclosed.

BACKGROUND OF THE INVENTION

Several retractable screen doors are known. For example, U.S. Pat. No. 3,842,890 to Kramer, et al disclose coilable closure device to open or close a door opening. The device includes a frame, a guide means, a vertical storage chamber and a single sheet of plastic vertically coilable upon itself within the storage chamber.

U.S. Pat. No. 4,458,739 to Murray, et al disclose an insulative window shade assembly of the roll-up type for windows or like openings. The window shade includes a flexible sheet of shade material which in its inoperative condition is contained in a header or a casing mounted on the top of the opening and extending across the width of the opening. The casing contains a spring actuated roller upon which a sheet of shade material is wound with a leading edge protruding through the longitudinal slot or opening of the casing.

U.S. Pat. No. 4,821,786 to Johnson discloses a reelable door closure. The closure is for covering the door opening and includes a recoilable spool of closure material such as plastic, or screen cloth which moves horizontally across a doorway and is stabilized by a top track hanger and a vertically extending locking and stabilizing member secured to the free end of the closure material.

U.S. Pat. No. 5,505,244 to Thumann discloses a retractable covering for a door opening. The retractable covering includes a housing mounted on one side of the door and a latching strip mounted on the opposite side of the door. The housing contains a roll of screen or similar sheeting material that can be pulled out of the housing across the door opening. One side edge of the screen is fixed to a biased roller assembly inside of the housing, the other side edge of the screen is affixed to a rigid side member that has a formation that engages with a formation on the latching strip of the opposite side of the door.

U.S. Pat. No. 514,966 to Schluns discloses a coiled sliding door consisting of a double series of vertical strips overlapping each other and secured on the opposite sides of transverse connecting bands in combination with metallic clips which are fixed centrally to the bands and clipped outwardly at each end to receive and hold the vertical chips.

U.S. Pat. No. 1,113,721 to Watson discloses a knockdown roller-screen. The screen comprises side cases having open lengthwise channels therein on the two opposite sides of the window casing. The side casings have open ended sidewise housings on their lower ends and a crosswise roll case insertable into the sidewise housings to detachably connect the side cases.

U.S. Pat. No. 1,143,718 to McPherson discloses a roller window screen including a window frame, a guard mounted at the upper portion of the frame, a roller mounted in the guard, a wire mesh mounted on the roller and arranged to pass around the lower edge of the guard, and flexible reinforcing members secured to the edges of the mesh.

U.S. Pat. No. 1,340,797 to Schoch discloses a window screen including a combination window screen and shade roller bracket. The window screen has an elongated body portion, ears projecting forwardly from the ends of the body portion and having spaced slots and openings, and lugs depending from the lower edge of the body portion adjacent to the opposite ends, the lugs being offset forwardly of the body and constituting stops.

U.S. Pat. No. 1,608,667 to Poetsch discloses a window ventilator comprising a flexible porous strip adapted to be stretched across an opening of a window, means for one strip in the housing therefor. The ventilator comprises a tubular body, and end pieces of sheet metal bent in the form of a U to provide a slot therein, the body having inwardly extendible flanges slidably extending into the slot, whereby the end pieces are secured to the body.

U.S. Pat. No. 2,015,993 to Drake discloses a sliding window screen for horizontal operation in window openings. The screen comprises a spring roller housing, closure member attached thereto, the closure member having a draw-bar, a guide member for attachment to a window seal, and a guide member attached to a vertically sliding sash wherein the position of the last mentioned varies with the position of the sash and at a end member to which the drawbar may be attached.

U.S. Pat. No. 2,098,105 to Nye discloses a roller screen. U.S. Pat. No. 2,543,118 describes a window screen including a tubular roller having annular heads on each end and disc-like members within the tubular roller at each end.

U.S. Pat. No. 2,580,776 to Herman describes a rolling window screen having a spring roller with screening material rolled thereon and a pivot pin at one end of the roller and a flat pin at the spring end of the roller. The screen has a compartment having one side open, a pivot bracket secured at one end of the compartment for receiving the pivot pin and a pair of slide receiving slots at the other end of the compartment.

U.S. Pat. No. 2,605,823 to Lockhart discloses a roller screen adapted for use with a window sash slidable in a window frame having a rail extending transversely of the frame, housing, roller screen mounted inside the housing, attachment members for attaching one end of the screen to the frame. In addition, there is marketed a product called a phantom screen which is a disappearing screen for doors and windows.

The above roller and retractable screens in the prior art are very difficult to install and require custom fitting to accommodate variable size window and door openings.

The construction frame and retractable screen of the present invention are designed to fit a range of sizes and variations for standard door openings and window openings. The c frame of the invention will accommodate opening size variations using a single size screen frame due to a unique detachable clip design present in the frame.

SUMMARY OF THE INVENTION

The present invention provides a self-supporting construction frame, including two vertical or horizontal portions; and two horizontal portions; wherein one of the two vertical portions is an anchor portion; and wherein the two horizontal portions are detachably coupled to the two vertical portions.

In one embodiment, the self-supporting construction frame may be removably inserted into a construction opening. In a preferred embodiment the construction opening accommodates either a door or a window. Advantageously the self-supporting construction frame is self-squaring relative to the construction opening.

In one embodiment, the invention provides a self-supporting construction frame anchor portion which includes a housing. In an alternative embodiment, the self-supporting construction frame housing stores a spring-activated, retractable screen. The spring-activated screen may be retracted horizontally or vertically. The spring-activated, retractable screen may be detachably fastened to a vertical portion opposite to the anchor portion.

The invention also provides, in one embodiment, a spring-activated, retractable screen which is detachably fastened to a vertical portion opposite to the anchor portion by a magnet disposed in the vertical portion opposite to the anchor portion. The spring-activated, retractable screen may be detachably fastened to a vertical portion opposite to the anchor portion by a latch.

The invention provides for tension adjustment of the spring-activated, retractable screen housed in the anchor portion. Preferably, the self-supporting construction frame is removably inserted into a construction opening, and the spring-activated, retractable screen is housed in the anchor portion and is accessible for adjustment of the tension of the spring.

The invention also provides, in one embodiment, for a construction frame in which the two horizontal portions are detachably coupled to the two vertical portions by interlocking clips. The interlocking clips may be attached to either the two horizontal portions or the two vertical portions. The two horizontal portions or the two vertical portions include a receptacle or mate for the clips of the opposite portion (vertical or horizontal). The interlocking clips may be detachably coupled to the horizontal portions and the vertical portions of the self-supporting frame.

In an alternative embodiment, the interlocking clips are detachably coupled to ends of the horizontal portions and the vertical portions.

The anchor portion of the construction frame provides for flexible adjustment of the horizontal portions of the construction frame, relative to the vertical portions, when the horizontal portions are detachably coupled to the vertical portions.

The above and other objects of the invention will become readily apparent to those of skill in the relevant art from the following detailed description and figures, wherein only the preferred embodiments of the invention are shown and described, simply by way of illustration of the best mode of carrying out the invention. As is readily recognized the invention is capable of modifications within the skill of the relevant art without departing from the spirit and scope of the invention.

BRIEF DESCRIPTION OF THE FIGURES

FIG. 3 shows a back view of the handle attachment location.

DESCRIPTION OF THE INVENTION

The self-supporting construction frame in accordance with the invention is designed to fit a range of sizes for standard window and door heights. For example, a standard door height which is generally 80 inches. Alteration of a standard door height often occurs due to framing, and can change the door opening height and create variations in the standard door opening. Due to the variance in standard door openings, prior art doors had to be custom fit to each different door opening or door frame.

The self-supporting construction frame in accordance with the invention will accommodate these variations, an will generally avoid the necessity of custom fitting doors or windows in construction openings with minor variations in standard door and window sizes.

In one embodiment, the self-supporting construction frame, comprises: two vertical portions (an anchor portion and a jamb); and two horizontal portions (two guide rails). One of the two vertical portions is an anchor portion; and the two horizontal portions are detachably coupled to the two vertical portions. The self-supporting construction frame may be removably inserted into a construction opening. In a preferred embodiment the framed construction opening accommodates either a door or a window. Advantageously, the self-supporting construction frame is self-squaring relative to the construction opening.

Figure 1:
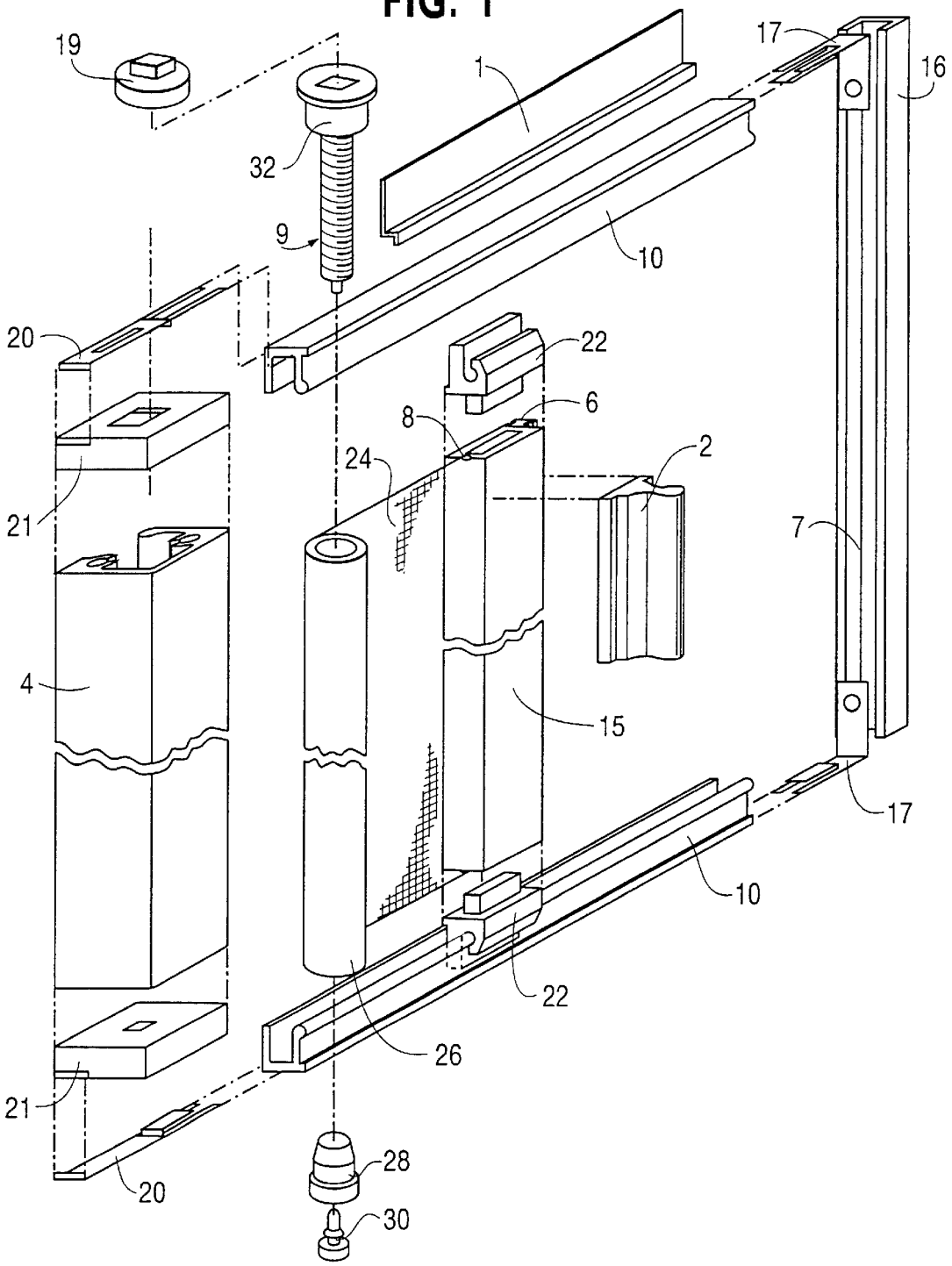
FIG. 1 shows a blow-up view of a retractable screen in a construction frame of the present invention.

Referring now to the figures, FIG. 1 depicts an embodiment of the construction frame in accordance with the present invention, wherein the construction frame houses a retractable screen. In this embodiment cover (4) represents the anchor portion of the construction frame. The cover (4) is bounded at each end by a cover end (21) to which a cover clip (20) is attached. Cover clip (20) may be detachably removed from guide rail (10), and cover clip (20) is located at the end of the guide rail (10), near the anchor portion (4). At the opposite end of the guide rail (10), jamb clip (17) is attached to jamb (16) which houses a jamb magnet (7).

In this embodiment, a screen tube (26) is housed in anchor portion (4). The screen tube (26) includes a tube cap (28) and a pivot pin (30) at the lower portion of the screen tube contacting the bottom guide rail (10). Pivots at the upper and lower portions of the guide rail, in a preferred embodiment include ball bearings for improved pivot action. The screen tube (26) houses a spring (9) covered by a spring assembly (32). The spring assembly (32) includes an insert (19) which allows for tension adjustment of the spring (9).

A screen (24) is housed in the screen tube (26). A pull rail (15) is attached to the screen (24). The pull rail (15) includes end caps (22) at either end which engage upper and lower guide rails (10). The pull rail also includes a handle (2) for opening and closing the screen. The end of the pull rail includes a rail magnet (6) which engages into the jamb (16). The top guide rail (10) may include a top seal (1) for sealing any open space construction opening.

Figure 2:
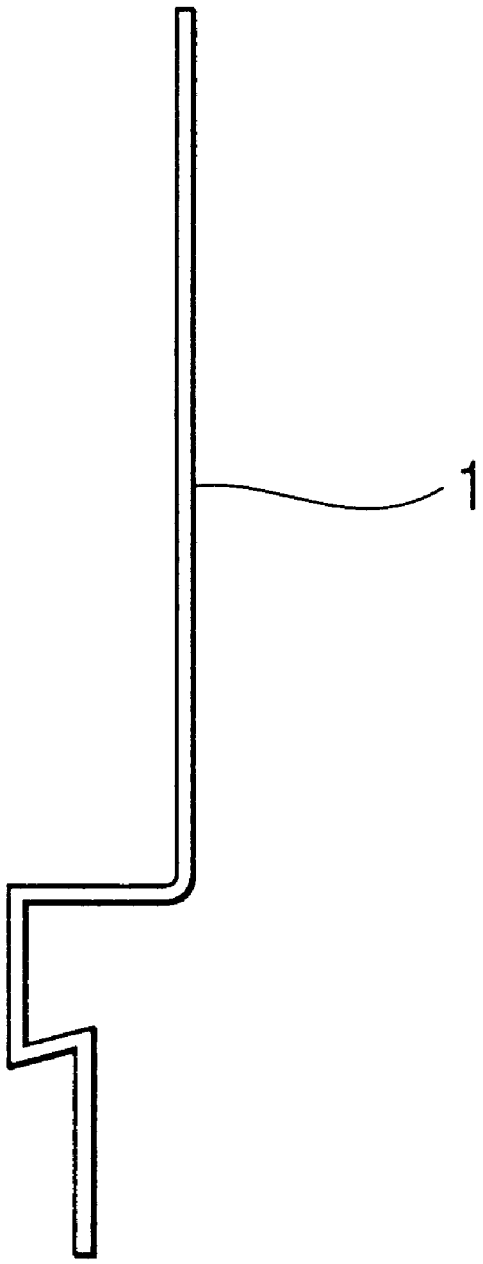
FIG. 2 shows a top seal which may be used for the construction frame of the present invention.
Figure 3A:
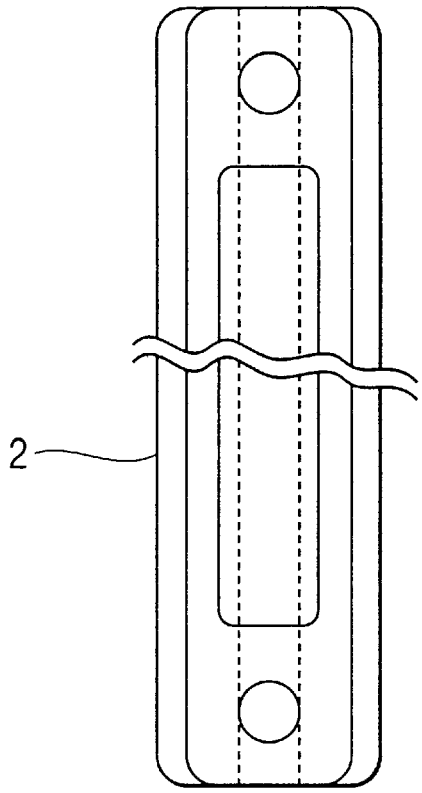
FIG. 3 shows a handle which may be used on a construction frame in accordance with the present invention.
FIG. 3*b* shows a top yew of the handle.
Figure 3B:
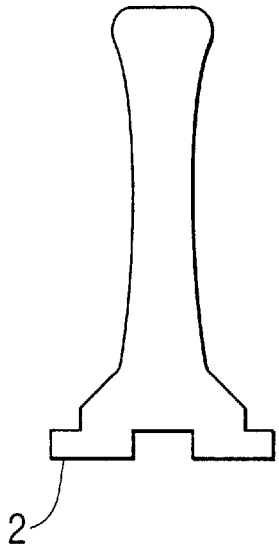

FIG. 2 depicts a detailed drawing of the top seal (1) in accordance with the present invention. FIG. 3 shows detailed drawings of the handle (2) which may be attached to the pull rail (15).

Figure 4:
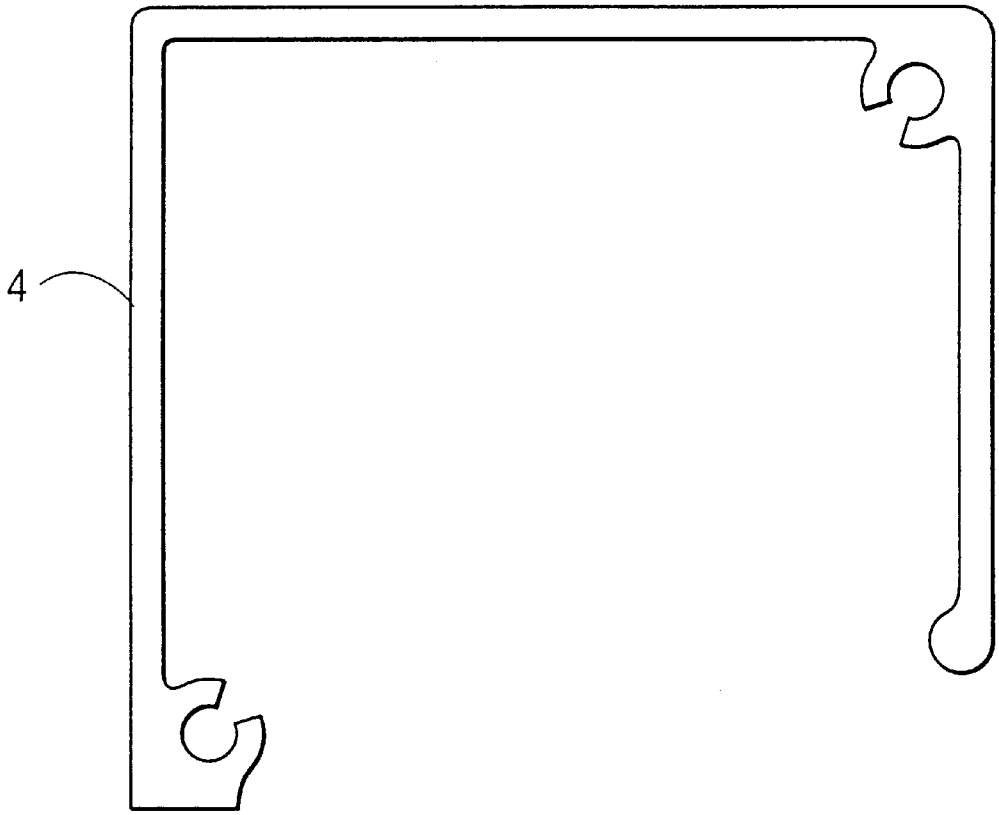
FIG. 4 shows a cover which may be used to cover the screen housing end portion of the present invention.
Figure 5A:
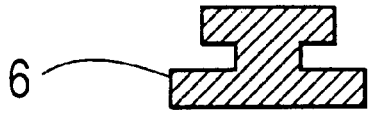
FIG. 5*a* shows a rail magnet.
Figure 5B:
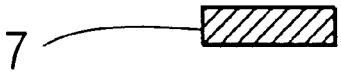
FIG. 5*b* shows a jamb magnet.
Figure 5C:
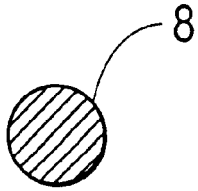
FIG. 5*c* shows a spline in accordance with the present invention.

FIG. 4 shows a detailed drawing of the cover (4) of the anchor portion of the present invention. FIG. 5*a* depicts a cross-section of a rail magnet (6) which is attached to pull rail (15), shown in FIG. 9, by sliding rail magnet (6) into a corresponding groove in the pull rail (15) for the full length thereof FIG. 5*b* depicts a cross section of jamb magnet (7) which is attached to jamb (16), shown in FIG. 10, by sliding jam magnet (7) into a corresponding groove in the jamb (16) for the full length thereof. FIG. 5*c* depicts a cross section of a spline (8) which holds screen (24) in position on pull rail (15) by inserting the spline (8) and screen (24), simultaneously into the corresponding groove in the pull rail (15).

Figure 6A:
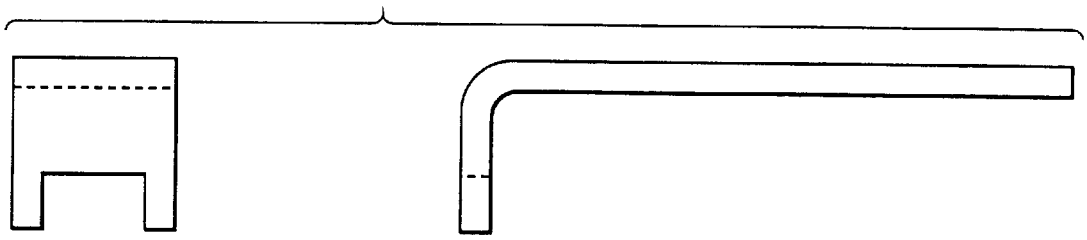
FIG. 6*a* shows an adjusting wrench which may be used to adjust the tension of the present invention.
Figure 6B:
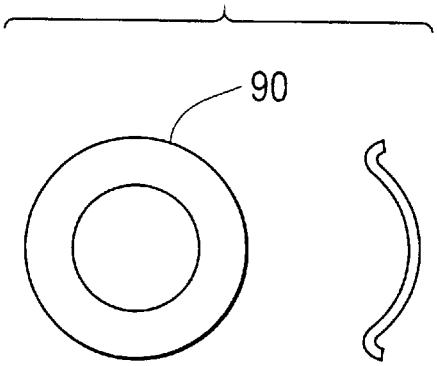
FIG. 6*b* shows a spring which may be used in the anchor housing of the present invention.
Figure 7A:
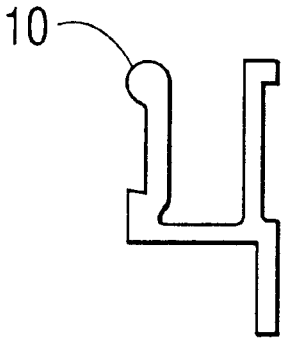
FIG. 7*a* shows an external view of a guide rail which may be used with the construction frame of the present invention.
Figure 7C:
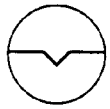
FIG. 7*b* shows a guide rail including a threshold which may be used in accordance with the present invention.
Figure 7B:
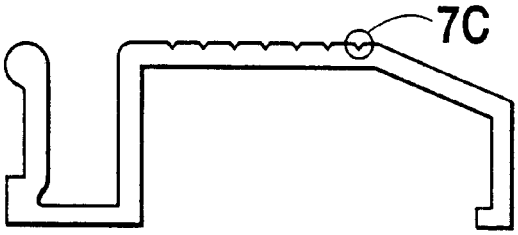
Figure 8:
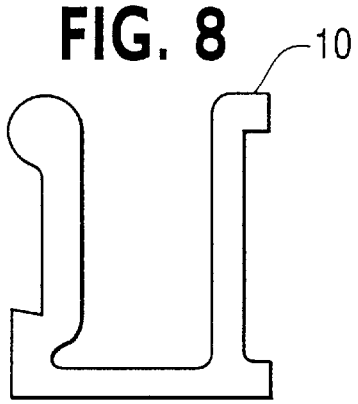
FIG. 8 shows a detailed depiction of a guide rail in accordance with the present invention.
Figure 9:
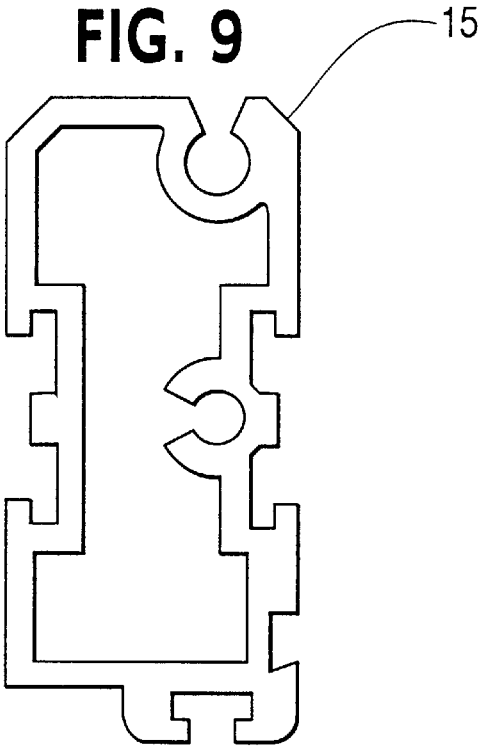
FIG. 9 shows a pull rail which may be used in a door inserted into the construction frame of the present invention.

FIG. 6*a* depicts an adjustment wrench which may be used to adjust the tension of the spring and thus the amount of force required to close the screen. The wrench is inserted to insert 19, shown in FIG. 12, and depressed against the insert spring until the insert releases from a retaining notch or opening in the cover end (21). When the insert has separated from the notch, the torsion spring assembly 9 may be adjusted. When pressure from the wrench is released, the insert spring returns the insert to its new position in the cover end. FIG. 6*b* shows a view of a spring 90 in accordance with the present invention. FIG. 7 shows a guide rail (10) (FIG. 7*a* shows an alternative guide rail (10) which includes a threshold (11) FIG. 7*b*). FIG. 8 shows a detailed drawing of a guide rail (10) in accordance with the present invention. FIG. 9 depicts a pull rail in accordance with the present invention.

Figure 10:
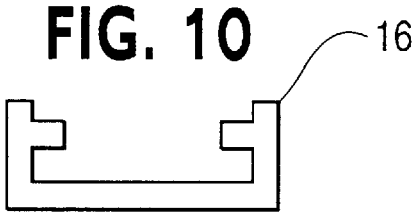
FIG. 10 shows a door jamb which may be used with the construction frame of the present invention.
Figure 11A:
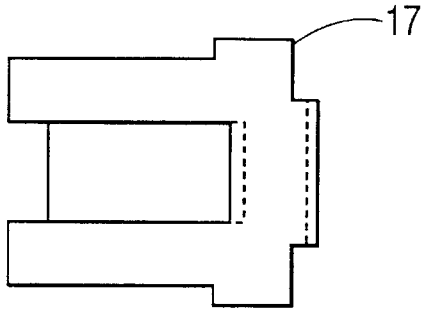
FIG. 11*a* shows a jamb clip in accordance with the present invention.
Figure 11B:
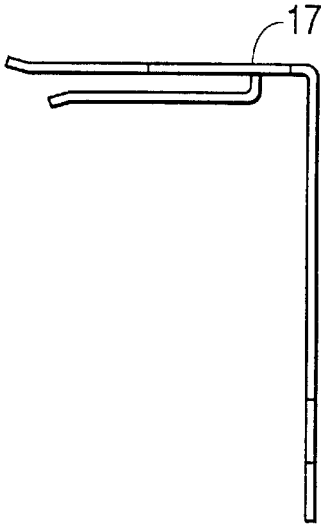
FIG. 11*b* shows a side view of the jamb clip in accordance with the present invention.
Figure 11C:
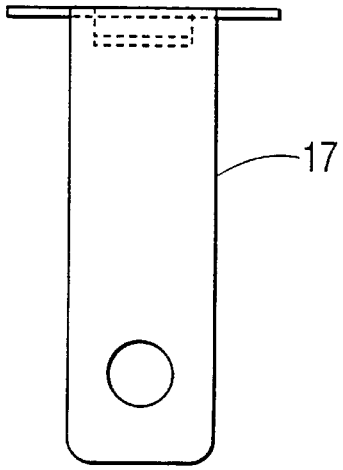
FIG. 11*c* shows a bottom view of the jamb clip of the present invention.
Figure 12A:
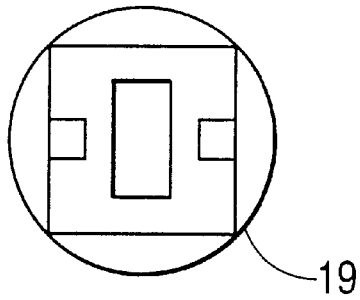
FIG. 12 shows an insert which covers the torsion adjustment portion of the construction frame used in the construction frame of the present invention.
Figure 12B:
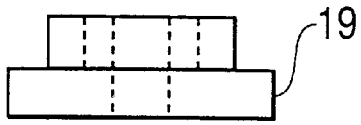
Figure 12C:
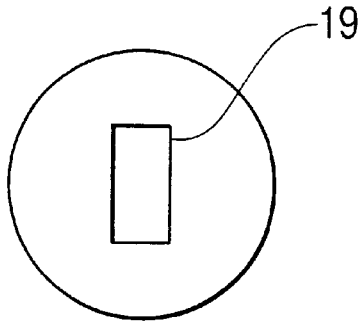

FIG. 10 depicts a jam (16) in accordance with the present invention. FIG. 11*a* shows a top view of the jamb clip (17) in accordance with the present invention. FIG. 11*b* shows a side view of the jamb clip (17) in accordance with the present invention. FIG. 11*c* shows the attachment portion of the jamb clip of the present invention where it attaches to jamb (16). FIG. 12*a* shows the insert (19) which may be used to allow for tension adjustment. FIG. 12*b* shows a side view of the insert (19). FIG. 12*c* shows a top view of the insert (19).

Figure 13C:
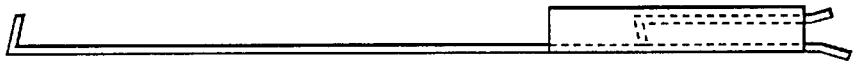
FIGS. 13(*a*), 13(*b*) and 13(*c*) show a view of a cover which includes a clip top of the present invention.
Figure 13A:
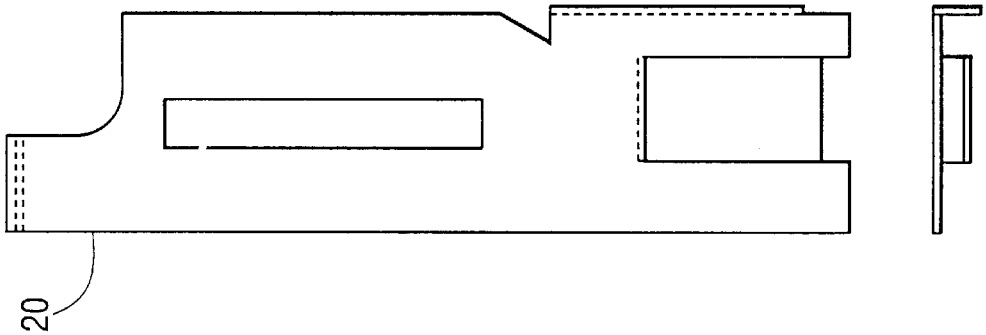
Figure 13B:
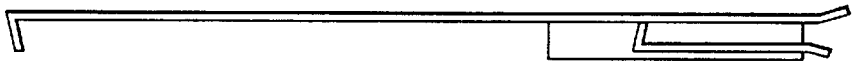
Figure 14C:
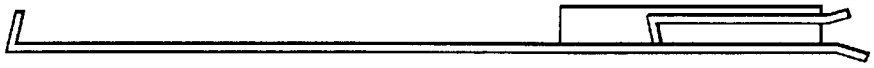
FIG. 14 shows a cover clip bottom in accordance with the present invention.
Figure 14A:
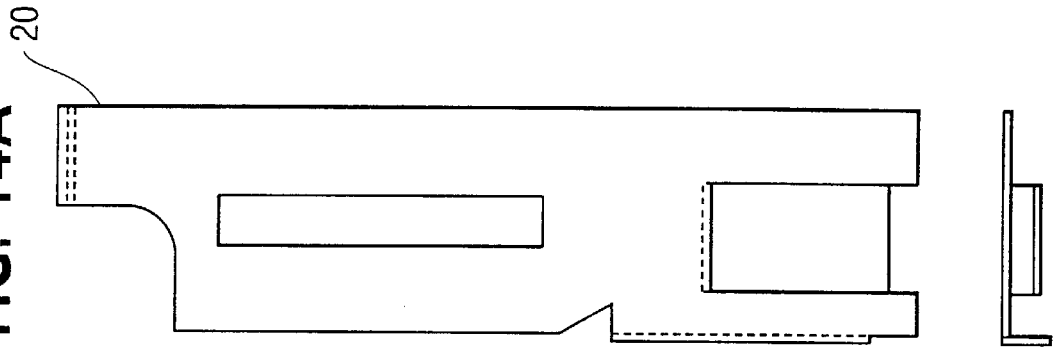
Figure 14B:
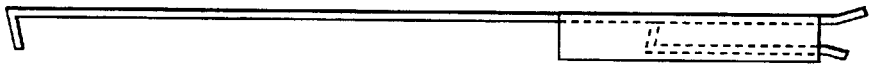

FIG. 13(*a*) shows a top view of a cover clip (20) in accordance with the invention. FIGS. 13(*b*) and 13(*c*) show side views of the cover clip in accordance with the invention. FIG. 14 shows a cover clip bottom in accordance with the present invention.

Figure 15A:
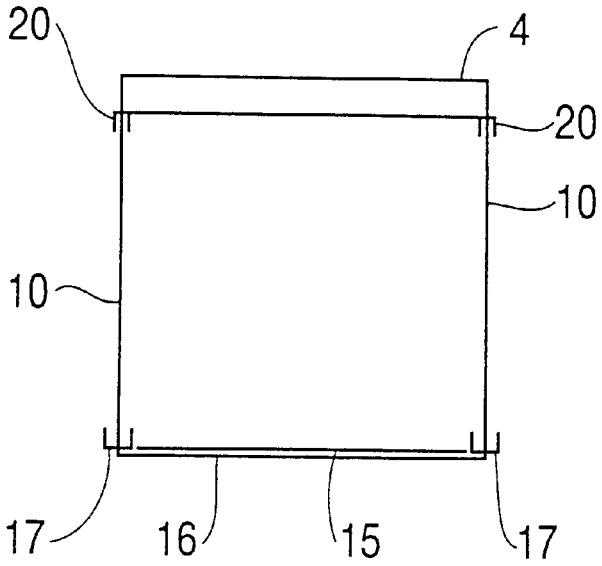
FIG. 15 shows vertical and horizontal orientations of a construction frame of the present invention.
Figure 15B:
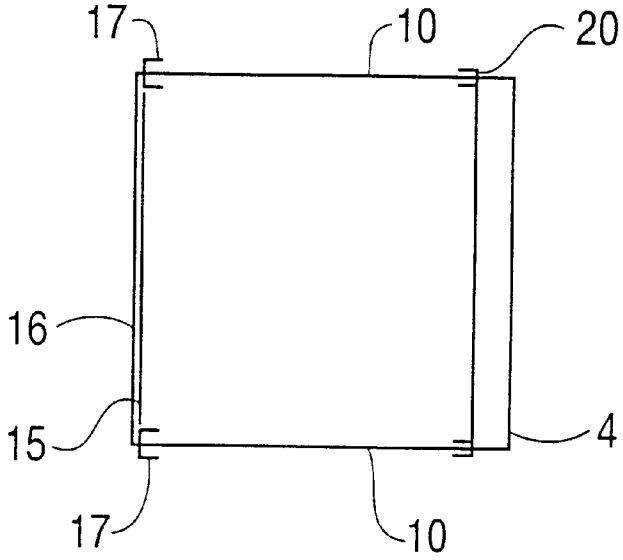

FIG. 15 shows alternative possible installations of a construction frame in accordance with the present invention. FIG. 15*a* shows a horizontal positioning of the anchor portion (4) in relation to vertical guide rails (10) in the construction frame of the invention. FIG. 15*b* shows vertical anchor portion (4) in relation to horizontal guide rail portions (10). The embodiment of the construction frame in FIG. 15*a* may be used to enclose a screen, vertical blind or shade. The embodiment of FIG. 15*b* with the anchor portion in a vertical position may be used to house a retractable screen, a door or a window.

Figure 16A:
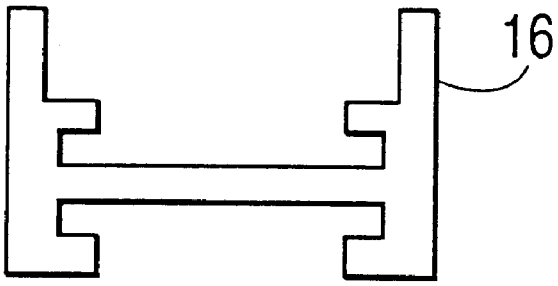
FIG. 16, shows a jamb and jamb support in accordance with the present invention.
Figure 16B:
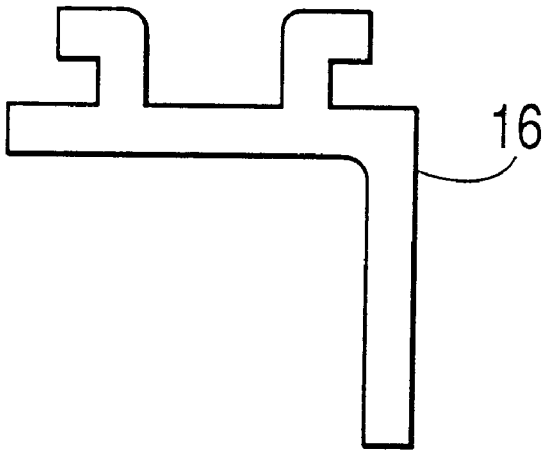

FIG. 16 shows a jamb and jamb support used for construction frame face mounting. FIG. 16(*a*) shows a door jamb and FIG. 16(*b*) shows a jamb support which may be used with a door in accordance with the invention. The jamb can be installed directly onto the door frame for inside door frame installations. The jamb can be directly fastened to the jamb support for door face installations. The jamb may include predrilled clearance holes for mounting and the jamb support has matching tapped holes to accept fastening screws from the jamb.

In one embodiment, the self-supporting construction frame anchor portion includes a housing. In an alternative embodiment, the self-supporting construction frame housing stores a spring-activated, retractable screen. The spring-activated screen may be retracted horizontally. The spring-activated, retractable screen may be detachably fastened by a vertical portion opposite to the anchor portion. In one embodiment the spring-activated, retractable screen is detachably fastened to a vertical portion opposite the anchor portion by a magnet disposed in the vertical portion opposite to the anchor portion. The spring-activated, retractable screen may be detachably fastened to a vertical portion opposite the anchor portion by a latch.

In a preferred embodiment the tension of the spring-activated, retractable screen housed in the anchor portion is adjustable. Preferably, the self-supporting construction frame is removably inserted into a construction opening, and the spring-activated, retractable screen housed in the anchor portion is accessible for adjustment of the tension of the spring.

In one embodiment, the two horizontal portions are detachably coupled to the two vertical portions by utilizing interlocking clips. The interlocking clips may be attached to both of either of the two horizontal portions or the two vertical portions. The other of the two horizontal portions and the two vertical portions includes a receptacle for the clip on the opposing portion. The interlocking clips may be detachably coupled to the horizontal portions and the vertical portions of the self-supporting frame.

In an alternative embodiment the interlocking clips are detachably coupled to ends of the horizontal portions and the vertical portions.

The anchor portion provides a stable anchor for the frame. The horizontal portions are flexibly adjustable relative to the vertical portions, due to the detachable coupling of the clips or other coupling means of the horizontal portions to the vertical portions.

In a preferred embodiment the self-supporting construction frame of the invention uses a single-sized frame comprising a clip in upper and lower guide rails. The construction frame in accordance with the present invention may be attached to the outer portion of an existing house frame or installed or inserted into an existing frame area.

The construction frame of the invention can be used, for example, for the installation of in or out swinging doors, screen doors, retractable screen doors, screens for windows, windows, and accordion doors.

In a preferred embodiment the construction frame of the invention is used for the installation of a retractable screen door. For example, screen door options for out-swinging doors are limited and are generally expensive. In many locations, new construction code requirements specify out-swinging doors only. The retractable screen which may be installed in the construction frame of the invention is ideal for out-swinging doors, screens for windows and doors of mobile homes which generally have out-swinging doors. The screen in the construction frame of the invention is also ideal for private residences, and avoids the use of a traditional screen doors which covers up the beauty of a stained glass or custom entry door.

Moreover, French doors and traditional screen doors are incompatible, however, if two of the screens of the invention are used in a single frame, the problem of screens accommodating French doors is solved.

The construction frame of the invention is easy to install for the homeowner or do-it-yourselfer.

In another embodiment, the construction frame of the invention including a screen, may be used with sliding glass doors. Traditional screens for sliding glass doors cover up one half of the door, restricting the view outside the door. In addition, traditional screen doors for sliding glass doors are clumsy, difficult to open and close, and need regular maintenance to function properly. A retractable screen door in accordance with the present invention can be retrofitted into any size sliding glass doorway or provided with newly manufactured sliding glass doors.

The retractable screen of the invention advantageously includes an external screen tensioning device. This device allows screen tension adjustment to accommodate variations in installation and maintenance, without disassembling the door. At present, prior art retractable screen doors require screen tension adjustment while in the possession of the manufacturer. The tension spring of the invention preferably has about 300 coils, has a pull strength of 5 to 7 pounds and is about 1 to 5 inches in diameter.

The jamb (vertical portion of the construction frame) used with the retractable screen door of the invention includes a full length magnet or multiple magnets to hold the screen in the closed position. In the alternative or in addition to the magnets, the screen may be held in the closed position by any closure means, including a hook, snap, latch, hasp or other closure means. The retractable portion of the screen includes a handle for ease of opening and closing the screen and also may include rolled or heat-sealed screen edges to insure ease of screen movement along the construction frame rails. In a preferred embodiment, a plastic or vinyl strip of suitable width is attached to the screen edges to allow for improved screen positioning, opening and closing, and to protect screen edges from fraying.

For screen applications, the construction frame of the invention preferably uses a 35,000 psi yield strength aluminum for the rails of the construction frame and a 12,000 psi yield aluminum for the jamb, threshold, and other parts of the construction frame. The components material is preferably a CELCON advanced nylon with ultraviolet ray (UV) protection. Alternatively, the screen material may be a vinyl coated fiberglass. In a preferred embodiment for screen applications, the guide rails do not require screw mounting to the existing door frame, and the rails are flexible or adaptable, and are self-squaring when the screen is in the open position. The flexible clips attaching the rails to the anchor portion and jamb, allow for this self-squaring ability of the horizontal portions of the construction frame including a screen.

If the construction frame of the invention is used to support a door other than a screen door, the guide rails are predrilled to accommodate screws which allow for fixing or securing the rails into place within or on the existing door frame. The anchor portion is adapted to accommodate door hinges.

Alternatively, the construction frame of the invention accommodating a screen can be used to cover a pass-through, such as a kitchen to patio window, for garage door openings, and for window screens.

When the construction frame of the invention is used to support an in- or out-swinging door, the frame may be modified to include appropriate weather stripping, thresholds or header pieces.

The guide rails of the present invention may be modified to include one or more tracks as necessary to accommodate multiple sliding or stationary screens, or sliding or stationary windows or doors. The rails may also accommodate accordion doors or windows. In an alternative embodiment, the construction frame of the invention may be adapted to accommodate blinds, vertical blinds, and securable window shades, etc.

The self-supporting construction frame of the present invention can be installed as follows. The following provides an example of a construction door frame or screen installation, and it should be noted that window or other appropriate construction frame installation should be readily understood therefrom.

First, one decides which side of a doorway opening to mount the anchor portion of the construction frame or screen housing assembly. Generally, the anchor portion of the construction frame for a screen is mounted on the same side as the hinges of a main entry door. The frame should be mounted on the inside of the doorway when an out swinging door is are present and screen installation is desired.

The construction frame may be mounted either on the inside of an existing doorway on or the outside of the doorway. If the construction frame or screen is mounted on the outside of the doorway, one must decide whether the mounting is to be on the face of the doorway frame, or on the inside of the door frame. Many existing doorframes are not wide enough to mount a standard size door or window construction frame or screen on the inside of the door frame, and so the construction frame of the invention must fastened to the face of the doorframe or window frame.

The frame or screen assembly is set in place to make sure that there is clearance for the anchor portion or screen assembly housing, and to make sure that the anchor portion and its housing cover with screws can be fastened securely to the door frame. Also, the vertical jamb should be set into place to make sure that there is adequate clearance for an entry door latch and lock, as appropriate.

If the construction frame is mounted to the face of the doorframe, a jamb support is used to mount the jamb to the face of the doorframe. If the construction frame is mounted inside the doorframe, a jamb support is not required.

The construction frame anchor portion or screen assembly should be level and square to the door sill. If mounting the construction frame on the face of the doorframe, the inside edge of the construction frame or screen assembly should be flush with the edge of the doorframe.

If a retractable screen is installed, one should make sure that the screen pulls out and retracts easily after the screws of the anchor portion are in place.

The lower guide rail of the construction frame or screen assembly may then be cut to length when the construction frame or screen is installed inside the do or frame. This can be measured using a tape or using the section of guide rail itself. The guide rail is marked with a pencil to the appropriate measurement and then the guide rail is cut to the appropriate length with a hacksaw or other cutting means. In a preferred embodiment the guide rails are pre-etched at the ends with measured break points, to allow for simplification of guide rail sizing.

The cutoff edge of the guide rail is filed or sanded to remove any cutoff burrs. The cutoff guide rail is then slipped between the screen assembly housing and the jamb, to insure that the guide rail has been cut to the correct length. The top guide rail is cut to the same length.

If the frame or screen is mounted on the outside face of the door frame, the following installation procedure is used. To cut the lower guide rail to length when the screen is installed outside and on the face of the door frame, the jamb is slid into the jamb support, and the jamb magnet is put into place. All three parts are fastened together using a size #8×⅜" flathead. It is important to make sure that the jamb clips are inserted into the top and bottom of the jamb before installing screws. The position of the jamb is located so that the edge of the jamb is f lush with the edge of the door frame. The distance between the screen assembly housing and the front of the magnet is measured. This can be measured using a tape measure or using the section of guide rail itself. The guide rail is marked with a pencil to this measurement and then cutoff the guide rail with a hacksaw or other cutting device. The cutoff edge of the guide rail is filed or scraped to remove cutoff burrs. The cutoff guide rail is slipped between the screen assembly housing and the jamb to insure that the guide rail has been cut to the correct length. The top guide rail is cut to the same length.

Next the cutoff guide rails are slid onto the upper and lower plastic end caps on the ends of the pull rail. Then the guide rails are inserted into the upper and lower cover clips and then into the plastic clips on the screen assembly end covers. With the guide rail in position, the jamb clip and jamb are slipped onto the free ends of the guide rails, making sure that the guide rails snap into the jamb until they are touching the magnet. The jamb, jamb clips, and guide rails are slid into position on the door frame. The jamb should be snug against the door frame if the guide rail was cut to the right length.

The jamb is fastened into position, screws are inserted into the face of the magnet through the jamb into the door frame or through the jamb support into face of the door frame.

Before tightening the screws, one should make sure that the jamb is level and square to the door sill and to the guide rails. The pull bar should be pulled out to nearly the full length of the screen to make sure there are no obstructions and the pull rail glides easily on the upper and lower guide rails. If a screen is installed, one should then retract the screen. If the jamb is not perpendicular to the lower guide rail, the screen may wrinkle when the screen is in its full close position. To correct this, one may have to shim behind the jamb at either the top or the bottom to level and/or square up the jamb to the guide rails. All screws should be tightened.

The upper guide rail should be held in position by the clips and require no screws to hold it in position. Alternatively, screws may be used to secure the guide rail. Because the frame or screen has a standard height to fit many different openings, an aluminum top cover is designed to fit into the gap between the top guide rail and the top of the door opening, when necessary.

Using a pair of scissors, the length of the top cover is cut to fit the opening width. The height of the gap above the upper guide rail to the inside top of the frame is measured and the top cover is cut to fit the opening. The top cover will snap into the upper guide rail to hold itself in position. The top cover is snapped into place and to determine if there is a need to cut along the top edge to provide a better fit better in the door opening. If the top cover is too high, it may be trimmed to fit.

The door, screen or window should be opened or closed a couple of times to make sure everything is functioning smoothly. An occasional silicone lubricant on the top and bottom guide rails can be very helpful to reduce friction and improve performance.

Therefore, the present invention provides a method of installing a construction frame comprising: mounting an anchor portion of a construction frame to a vertical portion of a construction opening, mounting a jamb in the opposite vertical portion of a construction frame, attaching horizontal guide rails to the anchor portion and jamb by detachable clips.

In another embodiment the invention provides for an installation kit for a construction frame comprising an anchor portion, a jamb, two guide rails and four detachable, interlocking clips. The installation kit may optionally comprises one or more of the following items: a retractable screen, anchor portion cover, jamb magnet, pivot pin, pull rail end caps, handle, threshhold, and top seal.

The purpose of the above description and examples is to illustrate some embodiments of the present invention without implying any limitation. It will be apparent to those of skill in the art that various modifications and variations may be made to the composition and method of the present invention without departing from the spirit or scope of the invention. All patents and publications cited herein are incorporated by reference in their entireties.

I claim:

1. A removable self-supporting construction frame, comprising:

two vertical portions; and two horizontal portions;

wherein said two horizontal portions are detachably coupled to said two vertical portions by respective removable interlocking clips therebetween to form the removable self-supporting construction frame;

wherein one of said two vertical portions or one of said two horizontal portions is an anchor portion and opposing other ones of said two vertical portions and said two horizontal portions are guide rails;

wherein said anchor portion includes a housing; and wherein said housing stores a retractable screen, a portion of said retractable screen being movable within said guide rails.

2. A self-supporting construction frame according to claim 1, wherein said screen is retracted horizontally.

3. A self-supporting construction frame according to claim 1, wherein said removable interlocking clips are removably attached to both of either of said two horizontal portions or said two vertical portions, and the both of the other of said two horizontal portions and said two vertical portions includes a receptacle therefore.

4. A self-supporting construction frame according to claim 1, wherein said interlocking clips are detachably coupled to each of said horizontal portions and said vertical portions, thus providing flexible adjustment for said horizontal portions relative to said vertical portions.

5. A self-supporting construction frame according to claim 4, wherein said interlocking clips are detachably coupled to ends of said horizontal portions and said vertical portions.

6. A self-supporting construction frame according to claim 1, wherein said anchor portion is detachably coupled to said horizontal portions and provides flexible adjustment for said horizontal portions relative to said vertical portions, when said horizontal portions are detachably coupled to said vertical portions.

7. A self-supporting construction frame according to claim 6, wherein said anchor portion is detachably coupled to said horizontal portions, when said horizontal portions are detachably coupled to said vertical portions, by interlocking clips.

8. A self-supporting construction frame according to claim 7, wherein the flexible adjustment for said horizontal portions relative to said vertical portions enables said construction frame to be accommodated in any sized ones of a door, a window, a mini blind, a vertical blind or a shade.

9. A self-supporting construction frame according to claim 7, wherein said self-supporting construction frame is self-squaring relative to said construction opening.

10. A self-supporting construction frame according to claim 1, wherein said retractable screen is detachably fastened to a vertical portion opposite to said anchor portion.

11. A self-supporting construction frame according to claim 10, wherein said retractable screen is detachably fastened to a vertical portion opposite to said anchor portion by a magnet disposed in said vertical portion opposite to said anchor portion.

12. A self-supporting construction frame according to claim 10, wherein said retractable screen is detachably fastened to a vertical portion opposite to said anchor portion by a latch disposed in said vertical portion opposite to said anchor portion.

13. A self-supporting construction frame according to claim 1, wherein a tension of said retractable screen housed in said anchor portion is adjustable.

14. A self-supporting construction frame according to claim 13, wherein said retractable screen housed in said anchor portion is accessible for adjustment of the tension thereof.

15. A method of installing a removable construction frame, said method comprising the steps of:

mounting an anchor portion of a construction frame to a vertical portion of a construction opening;

attaching horizontal guide rails to the anchor portion and a jamb by respective removable clips; and mounting the jamb in the opposite vertical portion of a construction frame to form the self-supporting construction frame, wherein said anchor portion includes a housing; and wherein said housing stores a retractable screen, a portion of said retractable screen being movable within said guide rails.

16. A removable self-supporting construction frame, comprising:

an anchor portion;

an anchor portion cover which covers said anchor portion;

a jamb disposed in parallel to said anchor portion;

two guide rails which are extended perpendicularly to said anchor portion and said jamb; and four removable interlocking clips which respectively interlock with and attach said guide rails to said anchor portion and said jamb to form the self-supporting construction frame, wherein said anchor portion includes a housing; and wherein said housing stores a retractable screen, a portion of said retractable screen being movable within said guide rails.

17. A self-supporting construction frame according to claim 16, further comprising:

a pivot pin;

end caps which seal said retractable screen in said anchor portion;

a handle attached to said anchor portion;

a threshold formed by a bottom one of said guide rails; and a top seal.

18. A removable self-supporting construction, comprising:

a pair of vertical portions detachably coupled to a pair of horizontal portions by a plurality of removable interlocking clips, wherein one of said two vertical portions or one of said two horizontal portions is an anchor portion and opposing other ones of said two vertical portions and said two horizontal portions are guide rails;

wherein said anchor portion includes a housing; and wherein said housing stores a retractable screen, a portion of said retractable screen being movable within said guide rails, and wherein the plurality of removable clips comprise:

a first planar portion formed in a first plane;

a second planar portion formed in a second plane; and a third planar portion spaced apart from the second planar portion and formed in the second plane, wherein the first planar portion, the second planar and the third planar portion are all integral, the first plane and the second plane are substantially parallel, and the first plane and the second plane are different planes.

19. The self supporting construction of claim 18, comprising a fourth planar portion formed in the second plane, wherein the fourth planar portion is integral with the first planar portion, the second planar portion and the third planar portion.

20. The self supporting construction of claim 18, comprising a fourth planar portion formed in a third plane, wherein the fourth planar portion is integral with the first planar portion, the second planar portion and the third planar portion, and the fourth plane is substantially perpendicular to the first plane and the second plane.

* * * * *